US005752900A

United States Patent [19]

Holland, Jr.

[11] Patent Number: 5,752,900

[45] Date of Patent: May 19, 1998

[54] EXERCISE BELT APPARATUS

[76] Inventor: Robert R. Holland, Jr., 2550 N. Federal Hwy., Suite 12, Fort Lauderdale, Fla. 33305

[21] Appl. No.: 816,508

[22] Filed: Mar. 13, 1997

[51] Int. Cl.[6] ..... A63B 21/02

[52] U.S. Cl. ..... 482/124; 482/69

[58] Field of Search ..... 482/121, 122, 482/124, 125, 69, 55, 105

[56] References Cited

U.S. PATENT DOCUMENTS

| | | | |
|---|---|---|---|
| 1,074,846 | 10/1913 | Dickman | 482/124 |
| 5,176,600 | 1/1993 | Wilkinson | 482/124 |
| 5,190,512 | 3/1993 | Curran | 482/124 |
| 5,203,754 | 4/1993 | Maclean | 482/124 |
| 5,306,222 | 4/1994 | Wilkinson | 482/124 |
| 5,362,295 | 11/1994 | Nurge | 482/124 |
| 5,372,565 | 12/1994 | Burdenko | 482/124 |
| 5,387,168 | 2/1995 | Bostic . | |
| 5,410,762 | 5/1995 | Maskovitch . | |
| 5,411,461 | 5/1995 | Tomascik . | |
| 5,518,480 | 5/1996 | Frappier | 482/124 |
| 5,647,827 | 7/1997 | Gutkowski et al. | 482/124 |

*Primary Examiner*—Lynne A. Reichard
*Attorney, Agent, or Firm*—Charles E. Baxley, Esq.

[57] ABSTRACT

An apparatus for upper body exercise includes a belt which has a pair of shoulder straps and leg straps to maintain the belt in position relative to the user's body. At least one elastic band has an end attached to an upper portion of the belt. The free end of the elastic band has a loop that can be pulled by a user for upper body exercise.

10 Claims, 2 Drawing Sheets

EXERCISE BELT APPARATUS

BACKGROUND OF INVENTION

The present invention relates generally to the field of exercise equipment and more particularly to an exercise belt apparatus which incorporates tension bands for upper body exercise.

DESCRIPTION OF THE PRIOR ART

The prior art related to exercise equipment includes the following examples of exercise belts:

U.S. Pat. No. 5,387,168 to Bostic teaches a stabilizing belt for cross-county skiing exercise apparatus which includes a belt which is attached to a pelvis support of the cross-country skiing exercise apparatus. The user secures the belt around his or her posterior and the belt stabilizes the user's pelvis relative to the pelvis support.

U.S. Pat. No. 5,410,762 to Maskovitch teaches an elastic strap which has two opposing slots through which a free end of a belt is threaded. A compact portable device, such as a tape recorder, is secured between the belt and the elastic strap. When the belt is tightened around the body, relative movement between the compact device and the user's body is minimized.

U.S. Pat. No. 5,411,461 to Tomascik teaches an exercise belt which includes an outer band of neoprene which expands and contracts in reaction to pulling and releasing of the belt by a towing force typically applied by dogs while the user is on skis. A continuous band of webbing is attached to the outer band and includes expansion loops which limit over-expansion of the outer band.

The above patents show devices in which a user is attached by the device to an exercise apparatus or in which the user is subjected to a towing force. Constructions of these devices make it impractical for the user to apply forces which result in efficient upper body exercise.

OBJECTS AND SUMMARY OF THE INVENTION

It is an object of the present invention to provide an exercise belt apparatus which can be used for upper body exercise in an efficient manner.

Another object of the present invention is to provide an exercise belt apparatus which provides a high degree of comfort for the user.

Another object of the present invention is to provide an exercise belt apparatus which incorporates a pair of flexible exercise bands for application of exercise forces.

Another object of the present invention is to provide an exercise belt apparatus which can be easily put on and removed from the user's body.

Another object of the present invention is to provide an exercise belt apparatus which can be easily stored when not in use.

Yet another object of the present invention is to provide an exercise belt apparatus which comprises a relatively small number of component parts that can be manufactured economically resulting in a low cost.

The foregoing and other objects and advantages of the present invention will appear more clearly hereinafter.

In accordance with the present invention there is provided an exercise belt apparatus which includes a belt member which encircles a waist of a user and which is securable around the waist by a hook and loop closure. A pair of shoulder straps may extend from the belt and pass over a user's shoulders and a pair of leg straps pass under the user's groin to hold the belt securely in place.

The upper edge of the belt member includes a plurality of apertures which are used to removably attach one or more flexible resilient exercise bands to the belt member. By grasping and pulling on the ends of the exercise bands, the user can exercise his or her upper body while simultaneously exercising his or her lower body by walking, jogging or running.

In an alternative embodiment of the present invention, an exercise glove is attached to an end of the exercise band to aid the user in grasping the exercise band.

BRIEF DESCRIPTION OF THE DRAWINGS

Other important objects and advantages of the present invention will be apparent from the following detailed description of the invention, taken in conjunction with accompanying drawings in which.

DETAILED DESCRIPTION OF THE INVENTION

Figure 1:
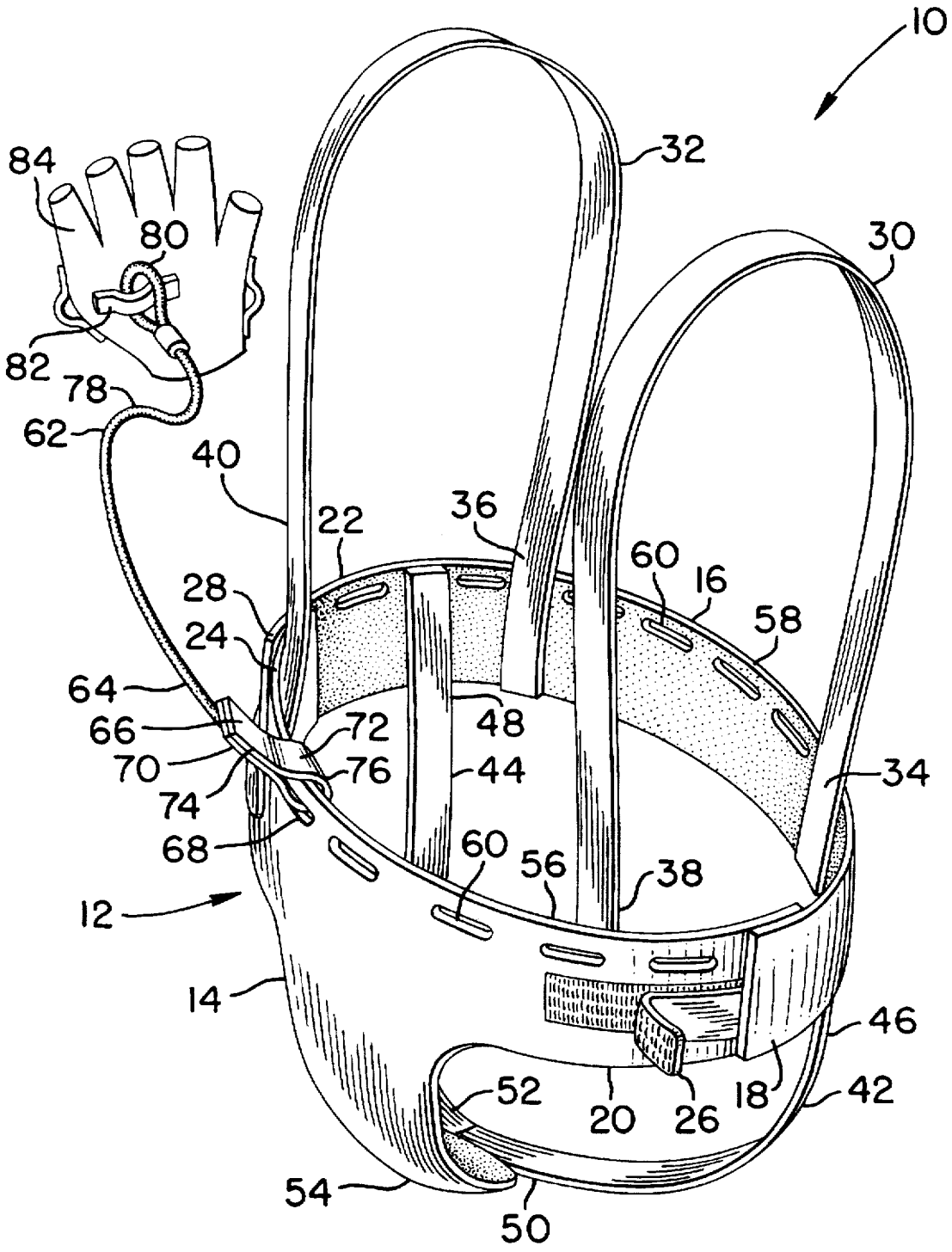
FIG. 1 is an overall perspective view of an exercise belt apparatus made in accordance with the present invention.
Figure 2:
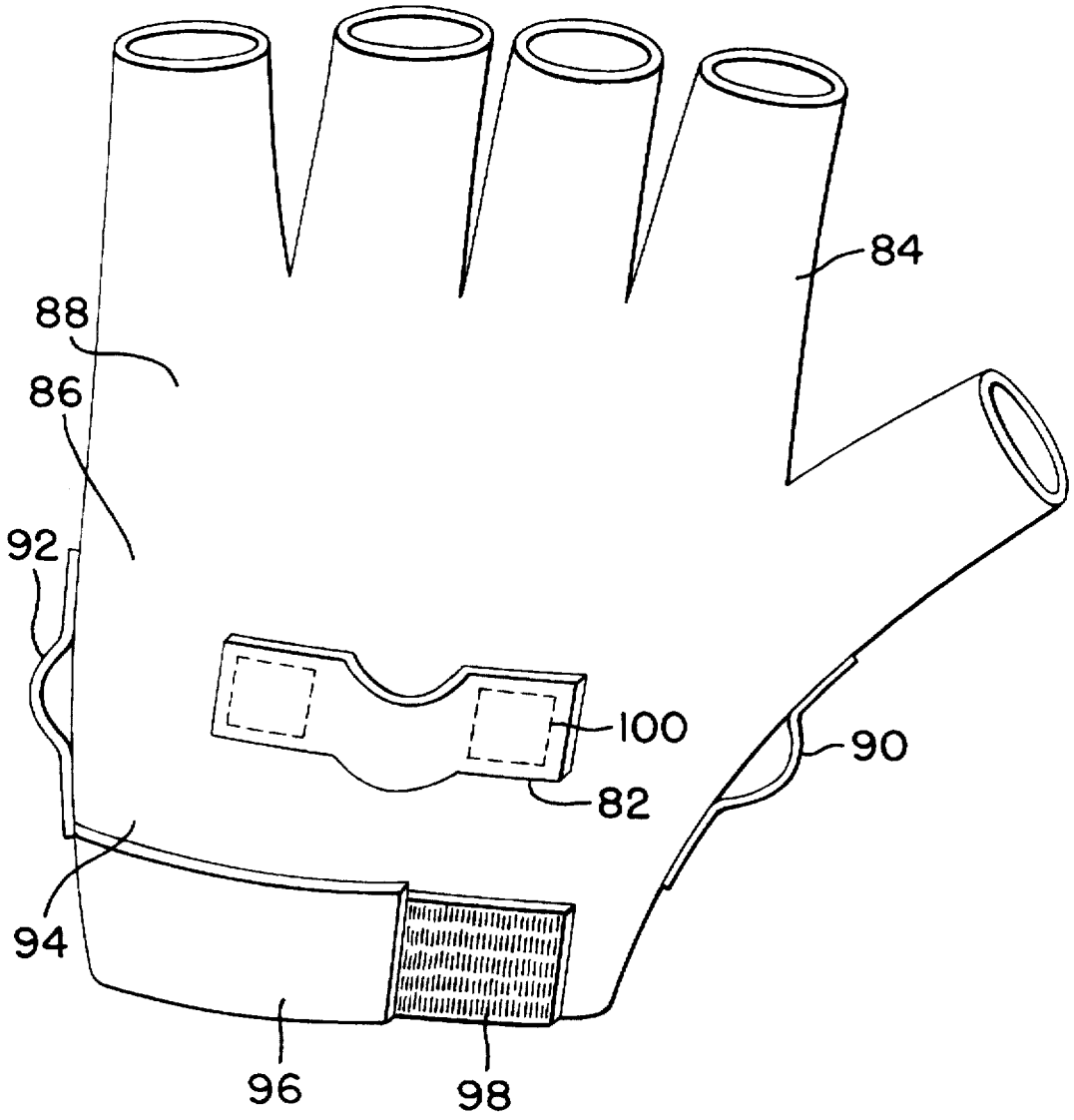
FIG. 2 is a plan view of an exercise glove for use with the exercise belt of FIG. 1.

With reference to the drawings, wherein like reference numbers designate like or corresponding parts throughout, there is shown in FIGS. 1 and 2 an exercise belt apparatus 10 made in accordance with the present invention.

Exercise belt apparatus 10 includes a belt assembly 12 which includes a front portion 14 and a rear portion 16. The front and rear portions 14, 16 each have first 18, 20 and second 22, 24 end portions are secured by hook and loop closures 26, 28, thereby providing adjustability to accommodate different users' waists, as is shown in FIG. 1. A pair of shoulder straps 30, 32 are provided which, during use, pass over shoulders of the user. Shoulder straps 30, 32 each has a first end 34, 36 secured to the rear portion 16 and a second end 38, 40 secured to the front portion 14.

A pair of leg straps 42, 44 are provided, each of which has a first end 46, 48 secured to rear portion 16 and a second end 50, 52 secured to a lower portion 54 of front portion 14.

Front and rear portions 14, 16 each has an upper edge 56, 58 and, proximate to upper edges 56, 58 there are formed a plurality of apertures 60 disposed in a linear array for the purpose of securing at least one, but preferably two, identical flexible elastic bands 62, only one of which has been shown for purposes of clarity of illustration. As is shown in FIG. 1, an exercise band 62 has a first end 64 which is connected to a relatively short strap 66 that passes through a selected aperture 68 and over upper edge 56. Strap 66 has a hook and loop closure 74 disposed between layers 70, 72 of strap 66, thereby enabling strap 66 to form a removable loop 76 which can be attached to any one of the apertures 60.

The second end 78 of the exercise band 60 has a loop 80 which can be grasped by a user for the purpose of pulling on the exercise band 62 thereby performing upper body exercises. The shoulder straps 30, 32 and the leg straps 42, 44 hold the exercise belt apparatus 10 in place on the user's body while the exercise is performed.

In an alternative embodiment of the invention, loop 80 is attached to a loop 82 formed on an exercise glove 84. Exercise glove 84, as is shown in FIG. 2, is conventional in construction with the exception that an intermediate portion 86 of the panel 88 of the exercise glove 84 includes three loops 82, 90, 92 for the attachment of an exercise band 62 and the lower portion 94 of the panel 88 includes a flap 96 which has a hook and loop closure 98 for adjustment on the hand of the user.

The exercise belt assembly 10 typically includes a pair of elastic bands, each identical to band 62. Bands of different colors, each having a different stiffness, may be utilized to provide different exercise forces. Elastic band 62 is preferably made of a strong flexible rubber such as neoprene, nitrile or butadiene rubber.

Front and rear portions 14, 16 may be made of leather or a plastic material such as a polyamide, such as NYLON brand of DuPont. Exercise glove 84 may be made of leather, and loops 82, 90, 92 may be secured by stitching 100.

The foregoing specific embodiments of the present invention as set forth in the specification herein are for illustrative purposes only. Various deviations and modifications may be made within a spirit and scope of this invention, without departing from a clearly discernable theme thereof.

I claim:

1. An exercise belt apparatus comprising:

a front portion having a first and second end and an upper edge;

a rear portion having a first end and a second end and an upper edge;

connection means removably connecting said first end of said front portion and said first end of said rear portion and removably connecting said second end of said front portion and said second end of said rear portion;

at least one elongated elastic band means having a first end and a second end; and removable attachment means disposed proximate said upper edge of said front portion and said rear portion for removable attachment of said first end of said elongated elastic band means to said front portion and said rear portion.

2. An exercise belt apparatus as claimed in claim 1, wherein said removable attachment means comprises:

an upper portion of said front portion having a linear array of apertures;

an upper portion of said rear portion having a linear array of apertures; and strap means disposed on said first end of said elongated elastic band means with said strap means passing through a selected aperture of said linear array of apertures.

3. An exercise belt apparatus as claimed in claim 1, further comprising:

loop means disposed on said second end of said elongated elastic band means.

4. An exercise belt apparatus as claimed in claim 1, in which said elongated elastic band means comprise a pair of elongated elastic bands.

5. An exercise belt apparatus as claimed in claim 1, further comprising:

a pair of elongated shoulder straps each having a first end secured to said rear portion and a second end secured to said front portion.

6. An exercise belt apparatus as claimed in claim 1, further comprising:

said front portion having an upper portion and a lower portion;

a pair of elongated leg straps with each of said elongated leg straps having a first end and a second end, with each of said first ends of said pair of elongated leg straps attached to said rear portion and with each of said second ends of said pair of elongated leg straps attached to said lower portion of said front portion.

7. An exercise belt apparatus as claimed in claim 1, in which said front and said rear portions are made of leather.

8. An exercise belt apparatus as claimed in claim 1, in which said front and said rear portions are made of flexible plastic.

9. An exercise belt apparatus as claimed in claim 1, in which said elongated elastic band means are made of rubber.

10. An exercise belt apparatus as claimed in claim 3, further comprising:

glove means; and attachment means disposed on said glove means for attachment of said glove means to said loop means on said second end of said elongated elastic band means.

* * * * *